US006893692B2

(12) United States Patent
Yoshizawa et al.

(10) Patent No.: US 6,893,692 B2
(45) Date of Patent: May 17, 2005

(54) INK JET RECORDING SHEET

(75) Inventors: Senichi Yoshizawa, Shizuoka (JP); Minoru Tsuchida, Shizuoka (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 195 days.

(21) Appl. No.: 10/348,007

(22) Filed: Jan. 22, 2003

(65) Prior Publication Data

US 2003/0143346 A1 Jul. 31, 2003

(30) Foreign Application Priority Data

Jan. 29, 2002 (JP) ..... 2002-019927

(51) Int. Cl.[7] ..... B41M 5/40
(52) U.S. Cl. ..... 428/32.34
(58) Field of Search ..... 428/32.34

(56) References Cited

U.S. PATENT DOCUMENTS 5,041,328 A * 8/1991 Akiya et al. ..... 428/212
6,001,463 A * 12/1999 Shibahara et al. ..... 428/32.25
6,096,157 A * 8/2000 Imabeppu et al. ..... 156/285
6,139,940 A * 10/2000 Iwamoto et al. ..... 428/32.34
6,183,851 B1 * 2/2001 Mishima ..... 428/304.4
6,245,422 B1 * 6/2001 Onishi et al. ..... 428/32.25
6,455,169 B1 * 9/2002 Iwamoto et al. ..... 428/500
6,476,083 B1 * 11/2002 Okura et al. ..... 516/93
2003/0118790 A1 * 6/2003 Ilda et al. ..... 428/195

FOREIGN PATENT DOCUMENTS

| | | |
|---|---|---|
| DE | 100 23 238 A1 | 11/2000 |
| EP | 1 120 281 A1 | 8/2001 |
| EP | 1 264 705 A1 | 12/2002 |
| EP | 1 279 697 A1 | 1/2003 |
| JP | 11-91242 | 4/1999 |
| WO | WO 01/25534 A1 | 4/2001 |

* cited by examiner

*Primary Examiner*—B. Shewareged
(74) *Attorney, Agent, or Firm*—Nixon & Vanderhye P.C.

(57) ABSTRACT

An ink jet recording sheet is provided which on recording produces an image with excellent gloss, and which is capable of producing a vivid full color image with a high print density. The ink jet recording sheet comprises a support, and an ink receiving layer containing δ-alumina provided on top of this support, wherein the ink receiving layer contains at least 20% by weight of δ-alumina. The ink receiving layer may also contain γ-alumina and/or θ-alumina. Furthermore, the ink receiving layer preferably contains from 65 to 97% by weight of the alumina mixture.

2 Claims, 1 Drawing Sheet

INK JET RECORDING SHEET

BACKGROUND OF THE INVENTION

1. Field of the Invention

The present invention relates to an ink jet recording sheet for use in an ink jet printer.

2. Description of the Related Art

Ink jet printers are widely used as they offer many superior properties including good recording clarity, quiet operation and easy access to color recording. Taking into consideration the impact on the environment, and the need to prevent blockages of the ink discharge nozzles resulting from drying of the ink, the ink used in these ink jet printers is usually not a solvent based ink, but is rather a water based ink in which a colorant such as a pigment or a dye and other additives are either dissolved or dispersed in water.

However, because water based inks use water as the solvent, the inks are slow to dry, and when sprayed onto recording sheets such as plain paper, the inks tend to bleed and cannot be reliably adhered to the sheet. As a result, recording sheets for recording with ink jet ink typically comprise an ink receiving layer, which displays good receptivity relative to water based inks, provided on top of a support. Examples of this ink receiving layer include layers comprising a mixture of a water soluble polymer such as polyvinyl alcohol, and a porous inorganic pigment such as amorphous synthetic silica, alumina such as α-alumina, or an alumina hydrate as the primary constituent. If the ink receiving layer is formed using this type of mixture, then the water based ink is absorbed instantaneously, and bonds reliably to the recording sheet.

In recent years, ink jet printers have become widely used for full color printing applications. An ink jet recording sheet for full color printing requires a high gloss in order to ensure vivid prints, and also needs to be capable of producing a highly detailed image with a high print density and no bleeding. However with conventional ink jet recording sheets, the gloss and print density following print recording has not been entirely satisfactory, and in full color applications, the printing of vivid prints has proved problematic.

The present invention takes the above factors into consideration, with an object of providing an ink jet recording sheet which on recording produces an image with excellent gloss, and which is capable of producing a vivid full color image with a high print density.

SUMMARY OF THE INVENTION

An ink jet recording sheet of the present invention comprises a support, and an ink receiving layer comprising at least δ-alumina formed on top of the support, wherein the ink receiving layer contains at least 20% by weight of δ-alumina.

In an ink jet recording sheet of the present invention, the ink receiving layer may further comprise γ-alumina and/or θ-alumina.

In addition, the ink receiving layer preferably contains from 65 to 97% by weight of an alumina mixture.

In this description, δ-alumina refers to alumina with a δ type crystalline structure, γ-alumina refers to alumina with a γ type crystalline structure, and θ-alumina refers to alumina with a θ type crystalline structure. Furthermore, an alumina mixture refers to a mixture comprising at least δ-alumina, as well as γ-alumina and/or θ-alumina.

DETAILED DESCRIPTION OF THE INVENTION

Figure 1:
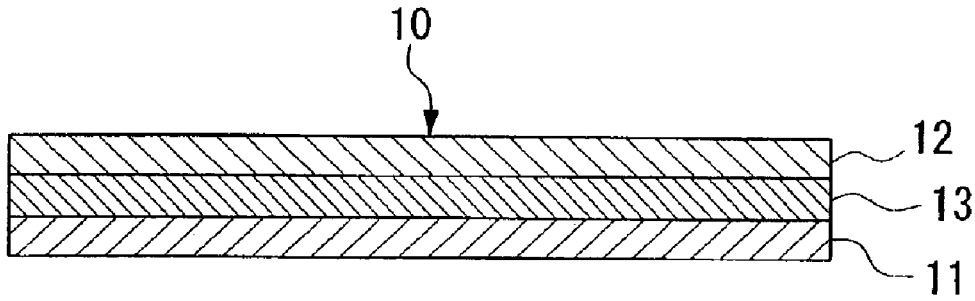
FIG. 1 is a cross-sectional view showing an embodiment of an ink jet recording sheet of the present invention.

As follows is a description of an embodiment of an ink jet recording sheet of the present invention, with reference to FIG. 1. An ink jet recording sheet 10 of this embodiment comprises a support 11, and an ink receiving layer 12 provided on top of this support 11, wherein the ink receiving layer 12 contains at least 20% by weight of δ-alumina. In addition, an undercoat layer 13 is provided between the support 11 and the ink receiving layer 12.

There are no particular restrictions on the support 11, provided it is capable of supporting the ink receiving layer 12, and suitable examples include non-transparent substrates such as paper, cloth and non-woven fabric, films formed from plastics such as polyethylene terephthalate, diacetate cellulose, triacetate cellulose, acrylic based polymers, cellophane, celluloid, polyvinyl chloride, polycarbonate and polyimide, as well as wooden sheets and glass sheets. Of these supports, paper is ideal.

The ink receiving layer 12 comprises at least 20% by weight of δ-alumina, and a resin. Provided the ink receiving layer 12 contains at least 20% by weight, and preferably from 30 to 90% by weight, and even more preferably from 40 to 80% by weight of δ-alumina, then the smoothness of the surface improves, the gloss and the print density also improve, and a vivid image with no bleeding can be obtained. It is thought that these observations are due to the ease with which the colorant constituents within the ink adsorb onto the δ-alumina.

In addition, the ink receiving layer 12 may also comprise γ-alumina and/or θ-alumina. If the ink receiving layer 12 also contains γ-alumina and/or θ-alumina, then the δ-alumina effects described above are further enhanced, and a high gloss, vividly colored, superior full color recording can be achieved. The alumina mixture may also comprise conventionally used α-alumina and β-alumina.

In those cases in which γ-alumina and/or θ-alumina is also included, the alumina mixture containing the δ-alumina, and the γ-alumina and/or θ-alumina can be produced using either of the following two methods. Namely, (1) a method in which aluminum hydroxide is calcined, with the calcination time and the calcination temperature controlled so as to generate all three types of alumina, and (2) a method in which different samples of alumina with each of the crystalline structures are physically mixed together.

Furthermore, in order to ensure a δ-alumina content within the ink receiving layer of at least 20% by weight, the ink receiving layer 12 preferably comprises from 65 to 97% by weight, and even more preferably from 75 to 97% by weight, and most preferably from 80 to 95% by weight of the alumina mixture. Provided the ink receiving layer 12 contains from 65 to 97% by weight of the alumina mixture, the ink receiving layer 12 displays excellent surface gloss, the adsorption of colorant constituents within the ink improves, and a full color image with almost no bleeding can be produced with even greater clarity.

There are no particular restrictions on the resin incorporated within the ink receiving layer 12 provided the resin is capable of receiving a water based ink, and suitable examples include acrylic resins, polyester resins, polyurethane resins, styrene-butadiene copolymer resins, polyvinyl alcohol based resins, water soluble polyvinyl acetal resins, polyvinyl butyral resins, amide based resins, oxidized starch, casein, polyethylene oxides, silicone resins, rosin modified maleic acid resins, rosin modified phenol resins, alkyd resins, and coumarone-indene resin. Of these resins, water soluble resins such as polyvinyl alcohol resins and water soluble polyvinyl acetal resins are preferred in terms of ink absorption, ink drying properties and the clarity of the recorded image.

Furthermore, the ink receiving layer 12 may also contain other additives for improving the water resistance and preventing ink bleeding. Examples of these other additives include melamine-formaldehyde resins, urea-formaldehyde resins, glyoxal and zirconium ammonium carbonate.

In addition, in order to further improve the productivity, the recording characteristics, and the storage stability, a variety of other additives may also be added to the ink receiving layer 12, including dispersants, thickeners, fluidity improvement agents, releasing agents, foaming agents, penetrants, colored dyes, colored pigments, fluorescent dyes, pH regulators, antifoaming agents, lubricants, ultraviolet absorption agents, antioxidants, preservatives, antibacterial agents, foam suppressants, hydration prevention agents, and wet paper strength enhancers.

Furthermore, if the ink receiving layer 12 displays a gloss value prior to recording, as measured by a 60° surface gloss test, of at least 10, and preferably at least 30, and a gloss value for black ink recorded sections following recording of at least 30, and preferably at least 45, then the gloss of the ink jet recording sheet 10 following full color recording will be high, and extremely vivid printing is possible.

The undercoat layer 13 is a layer for receiving ink which penetrates through the ink receiving layer 12, and functions as a separate ink receiving layer from the ink receiving layer 12 comprising the δ-alumina. This undercoat layer 13 enables superior ink drying properties to be achieved without ink bleeding.

There are no particular restrictions on the undercoat layer 13, and suitable examples include layers formed from a composition comprising a pigment and a binder as primary constituents. Examples of suitable pigments for use in the undercoat layer 13 include appropriately selected organic pigments or inorganic pigments. Specific examples of these organic and inorganic pigments include silica, clay, mica, swelling mica, talc, kaolin, diatomaceous earth, calcium carbonate, barium sulfate, aluminum silicate, synthetic zeolite, alumina, zinc oxide, lithopone and satin white. These pigments may be selected on the basis of factors such as the purpose of the recording, the application of the recorded image, and the adhesion with the ink receiving layer, although of the above pigments, silica is preferred as it offers superior ink absorption. δ-alumina or a mixture thereof may also be used as the pigment for the undercoat layer 13.

Furthermore, the binder used in the undercoat layer 13 can utilize those resins used in the ink receiving layer 12, and polyvinyl alcohol based water soluble resins are particularly preferred.

In addition to the undercoat layer 13, another ink receiving layer, separate from the ink receiving layer 12, may also be provided.

As follows is a description of a method of manufacturing an ink jet recording sheet 10 of the present embodiment. First, the materials which comprise the ink receiving layer 12, namely, an alumina mixture containing δ-alumina, and a resin and the like, are dissolved or dispersed in water or another solvent to prepare a coating liquid. Next, this coating liquid is applied onto either a support 11, or an undercoat layer 13 provided on top of a support 11, and is then dried, forming an ink receiving layer 12 on top of the support 11. If necessary, the ink receiving layer 12 is then subjected to surface treatment using a calender process, thereby yielding an ink jet recording sheet 10.

In the method of manufacturing an ink jet recording sheet described above, examples of suitable methods for forming the ink receiving layer 12 and the undercoat layer 13 on top of the support 11 include roll coating methods, blade coating methods, gravure coating methods, comma coating methods, rod bar coating methods, air knife coating methods, die coating methods, and cast coating methods. In addition, the ink receiving layer 12 may also be laminated onto the support 11 using hot melt coating methods or laminate coating methods.

Furthermore, if the ink receiving layer 12 is subjected to surface treatment using a calender process, as described in the above method of manufacturing an ink jet recording sheet, then the gloss of the ink jet recording sheet 10 can be improved even further.

In addition, the weight of the dried coating of the ink receiving layer 12 is preferably within a range from 5 to 40 $g/m^2$, and even more preferably from 15 to 25 $g/m^2$. If the weight of the coating exceeds 40 $g/m^2$, then any further increase in the coating quantity produces very little improvement in gloss or print density, and merely increases the cost. In contrast, if the coating quantity is less than 5 $g/m^2$ then the ink receiving layer may be insufficient to cope with the quantity of ink, and therefore the ink absorption would be inadequate. The weight of the dried coating of the undercoat layer 13 is preferably within a range from 5 to 25 $g/m^2$, and even more preferably from 5 to 15 $g/m^2$ .

EXAMPLES

As follows is a more detailed description of the present invention, based on a series of examples. In each of the following examples, unless otherwise stated, all references to "parts" and "%" refer to "parts by weight" and "weight percentage" respectively.

Production Example 1

Aluminum hydroxide was subjected to thermal decomposition at a thermal decomposition temperature of 500 to 700° C., and yielded an alumina mixture with a crystalline weight ratio of $\gamma/\delta/\theta$=20/60/20.

Production Example 2

Aluminum hydroxide was subjected to thermal decomposition at a thermal decomposition temperature of 200 to 300° C., and yielded an alumina mixture with a crystalline weight ratio of $\gamma/\delta/\theta$=100/0/0.

Production Example 3

Aluminum hydroxide was subjected to thermal decomposition at a thermal decomposition temperature of 300 to 500° C., and yielded an alumina mixture with a crystalline weight ratio of $\gamma/\delta/\theta$=90/10/0.

Production Example 4

Aluminum hydroxide was subjected to thermal decomposition at a thermal decomposition temperature of 800 to 1000° C., and yielded an alumina mixture with a crystalline weight ratio of $\gamma/\delta/\theta$=0/20/80.

Production Example 5

Aluminum hydroxide was subjected to thermal decomposition at a thermal decomposition temperature of 900 to 1000° C., and yielded an alumina mixture with a crystalline weight ratio of $\gamma/\delta/\theta=0/0/100$.

In the above production examples 1 to 5, the thermal decomposition temperature was adjusted, while the powder X ray diffraction spectrum was measured, and the crystalline weight ratio was calculated from the 2θ surface area ratio on the X ray diffraction chart.

Example 1

A coating liquid was first prepared from 50 parts of a dispersion produced by dispersing the alumina mixture of the production example 1 in water in sufficient quantity to produce a solid fraction of 40%, and 50 parts of a polyvinyl alcohol aqueous solution with a solid fraction of 5%. This coating liquid was then applied to paper of thickness 127 μm in sufficient quantity to produce a dried coating weight of 25 g/m$^2$, and subsequently dried to form an ink receiving layer, thereby yielding an ink jet recording sheet.

Example 2

A coating liquid was prepared from 50 parts of a dispersion produced by dispersing silica (Mizukasil P-78D, manufactured by Mizusawa Industrial Chemicals, Ltd) in water in sufficient quantity to produce a solid fraction of 15%, and 50 parts of a polyvinyl alcohol aqueous solution with a solid fraction of 5%. This coating liquid was then applied to paper of thickness 127 μm in sufficient quantity to produce a dried coating weight of 10 g/m$^2$, and subsequently dried to form an undercoat layer on top of the support. Next, the coating liquid used in the example 1 was applied to the surface of the undercoat layer, and then dried to form an ink receiving layer with a dried coating weight of 18 g/m$^2$, thereby yielding an ink jet recording sheet.

Example 3

With the exception of using an ink receiving layer coating liquid comprising 30 parts of a dispersion of the alumina mixture of the production example 1, and 70 parts of the polyvinyl alcohol aqueous solution, an ink jet recording sheet was produced in the same manner as the example 2.

Example 4

With the exception of using an ink receiving layer coating liquid comprising 20 parts of a dispersion of the alumina mixture of the production example 1, 30 parts of a 40% dispersion of the alumina mixture of the production example 4, and 50 parts of the polyvinyl alcohol aqueous solution, an ink jet recording sheet was produced in the same manner as the example 2.

Comparative Examples 1 to 4

With the exceptions of using the alumina mixtures of the production examples 2 to 5 respectively, instead of the alumina mixture of the production example 1, ink jet recording sheets were prepared in the same manner as the example 2.

The gloss (60°) values for the surface of the ink receiving layer in each of the ink jet recording sheets produced in the examples 1 to 4 and the comparative examples 1 to 4 described above were measured using a micro-TRI-gloss device manufactured by Gardner Co., Ltd. The results are shown in Table 1.

Furthermore, each of the ink jet recording sheets obtained in the examples 1 to 4 and the comparative examples 1 to 4 were cut to A4 size, and then used for full color recording using an ink jet printer (a PM-800C printer, manufactured by Seiko Epson Corporation). The gloss of a black ink recorded section was then measured in the same manner as described above. In addition, the print density of the black ink recorded section was also measured using a SPM50 device, manufactured by Gretag Co., Ltd. In addition, the image clarity of the full color recorded image was evaluated on the basis of whether the image displayed good gloss and vivid colors, with a good level of detail and no bleeding. The results of these evaluations were recorded as "A" in the case of superior image clarity, "B" in the case of good clarity, "C" in the case of a somewhat inferior image, and "D" in the case of an image no better than, or even worse than the level achievable with conventional technology. The results are shown in Table 1.

TABLE 1

| | | δ-alumina content | Gloss | | | |
|---|---|---|---|---|---|---|
| | Alumina mixture | within the ink receiving layer (%) | prior to recording | after recording | Print density | Image clarity |
| Example 1 | Production example 1 | 52.6 | 35 | 63 | 2.20 | A |
| Example 2 | Production example 1 | 52.6 | 32 | 62 | 2.18 | A |
| Example 3 | Production example 1 | 46.5 | 30 | 58 | 2.15 | A |
| Example 4 | Production examples 1 + 4 (2:3) | 32.0 | 26 | 45 | 2.02 | B |
| Comparative example 1 | Production example 2 | 0 | 14 | 12 | 1.75 | D |
| Comparative example 2 | Production example 3 | 8.9 | 18 | 18 | 1.94 | C |
| Comparative example 3 | Production example 4 | 17.8 | 22 | 25 | 1.65 | D |
| Comparative example 4 | Production example 5 | 0 | 12 | 10 | 1.57 | D |

In the examples 1 to 4, the ink receiving layer contained at least 20% by weight of δ-alumina, and as a result the gloss and print density of the ink jet recording sheets were high, and the clarity of the images was excellent.

In contrast, in each of the comparative examples 1 to 4, the δ-alumina content of the ink receiving layer was less than 20% by weight, and as a result the gloss of the ink jet recording sheet was lower. Furthermore, the print density values were also inferior to those of the examples 1 to 4, and the image clarity, as determined by visual inspection, was also unsatisfactory.

According to the present invention, an ink receiving layer containing δ-alumina is provided on a support, and because the ink receiving layer comprises at least 20% by weight of the δ-alumina, the smoothness of the surface improves, thereby improving the gloss, the print density also improves, and a highly detailed image with no bleeding can be obtained. Accordingly in full color applications, a highly vivid recording, unattainable with conventional technology, can be achieved.

What is claimed is:

1. An ink jet recording sheet comprising a support, and an ink receiving layer comprising δ-alumina, γ-alumina and θ-alumina formed on top of said support, wherein said ink receiving layer contains 30 to 90% by weight of δ-alumina.

2. An ink jet recording sheet comprising a support, and an ink receiving layer comprising δ-alumina, γ-alumina and θ-alumina formed on top of said support, wherein said ink receiving layer contains 30 to 90% by weight of δ-alumina and from 65 to 97% by weight of the alumina mixture.

* * * * *